United States Patent [19]

Ochmann

[11] 4,363,971

[45] Dec. 14, 1982

[54] METHOD OF AND APPARATUS FOR CONTROLLING THE ELECTRIC POWER APPLIED TO A ROTARY-ANODE X-RAY TUBE

[75] Inventor: Rudolf Ochmann, Hamburg, Fed. Rep. of Germany

[73] Assignee: U.S. Philips Corporation, New York, N.Y.

[21] Appl. No.: 167,908

[22] Filed: Jul. 14, 1980

[30] Foreign Application Priority Data

Jul. 5, 1979 [DE] Fed. Rep. of Germany ..... 2927207

[51] Int. Cl.[3] ..... H05G 1/26

[52] U.S. Cl. ..... 378/110; 378/144; 378/112

[58] Field of Search ..... 250/408, 409, 402, 406

[56] References Cited

U.S. PATENT DOCUMENTS 4,158,138 6/1979 Hellstrom ..... 250/408

FOREIGN PATENT DOCUMENTS 1050458 6/1957 Fed. Rep. of Germany .
2158865 6/1972 Fed. Rep. of Germany .
2345947 5/1975 Fed. Rep. of Germany .
2510984 9/1976 Fed. Rep. of Germany ..... 250/409
2721535 11/1978 Fed. Rep. of Germany .
2298917 9/1976 France ..... 250/409

*Primary Examiner*—Alfred E. Smith
*Assistant Examiner*—T. N. Grigsby
*Attorney, Agent, or Firm*—Jack E. Haken

[57] ABSTRACT

The temperature of the anode disc of a rotary-anode X-ray tube is continuously determined by means of the method apparatus in accordance with the invention. When the temperature exceeds a first limit value, the power of the X-ray tube is reduced to a fraction (for example, 80%) of the otherwise permissible power. When a second limit value of the anode disc temperature is exceeded, exposures are completely inhibited. In the case of exposures which are performed in rapid succession with a comparatively low power, it may occur that the anode disc temperature does not reach the second limit value, but that the mean value of the applied electric power is so high that the bearing of the rotary anode, and possibly also the joint between the anode shaft and the rotor, is overloaded. Overloading is prevented by generating a bearing-temperature signal indicative of the rotary anode bearing temperature and comparing it with a third limit value.

16 Claims, 9 Drawing Figures

METHOD OF AND APPARATUS FOR CONTROLLING THE ELECTRIC POWER APPLIED TO A ROTARY-ANODE X-RAY TUBE

The invention relates to a method of controlling the electric power applied to a rotary-anode X-ray tube in an X-ray generator in dependency of the anode temperature of the X-ray tube, the anode disc temperature being continuously determined and compared with a first limit value, the electric power applied to the X-ray tube being automatically reduced when the anode disc temperature exceeds the first limit value.

The invention further relates to an apparatus for controlling the electric load of an X-ray tube, said apparatus comprising:

generator means for supplying a high voltage to the X-ray tube, input means for supplying input signals determining the use of the X-ray tube, control means for controlling the generator means in dependency of the input signals, means for generating an anode temperature signal indicative of the temperature of the rotary anode disc of the X-ray tube, comparator means for comparing the anode temperature signal with a first limit value and for generating a reduction signal which is applied to the control means, said reduction signal in cooperation with the input signals determining a reduced load for the X-ray tube.

A method and apparatus of this kind are basically known from German Offenlegungsschrift No. 22 08 871. However, instead of the anode disc temperature (i.e. the temperature assumed by the anode disc when the heat applied to the focal spot has spread at least approximately uniformly across the complete disc), the temperature in the focal spot is measured. For the determination of the temperature there is provided an analog arithmetic circuit. A digital arithmetic unit could be used equally well, and the anode disc temperature could also be determined by measurement.

At the instant at which the focal spot temperature reaches the limit value according to the known method, the tube power is controlled so that the focal spot temperature corresponds exactly to the limit value. As a result of the automatic reduction of the power during the exposure, continuously changing exposure times occur in this limit range of the load for the same object, and no reproducibility can be obtained in respect of the movement unsharpness of the object. Moreover, this method does not take into account the fact that, even when the focal spot temperature is constantly checked, the rotary anode bearing, which is connected to the anode disc by way of a shaft having a comparatively high thermal resistance, can be heated to temperatures which lead to bearing damage and hence to reduced service life of the X-ray tube. Thus, in spite of the monitoring of the focal spot temperature, the X-ray tube is not protected against overloading in all cases.

The same is applicable to the method and apparatus which are known from German Auslegeschrift No. 1 050 458 where, as soon as the focal spot temperature reaches the limit value, the permissible further loading of an X-ray tube is fixed at a fraction of the load value permissible for the cold X-ray tube on the basis of its table of characteristic values or diagram.

Furthermore, from German Offenlegungsschrift No. 20 31 590 it is known to control an indicator in dependence of the anode temperature reached (measured by means of a radiation measuring probe) so that the remaining fraction of the permissible load of the cold X-ray tube is indicated. The operator, however, is then forced to recalculate the exposure parameters for the next exposure for the comparison into a percental load and to adjust the parameters again while taking into account the said limits; this is too complex and too time consuming for routine operation.

Finally, from German Offenlegungsschrift No. 23 45 947 it is known to simulate or measure the anode temperature and to perform a fast similation of the cooling of the anode disc in order to inform the operator about the waiting period, which has to expire after a limit value of the anode temperature has been exceeded, before the next exposure can be started without endangering the anode disc. However, like in all other described cases, overloading of the X-ray tube cannot be prevented when the mean power applied thereto becomes too high, because the limit value of the anode disc temperature is not reached in given circumstances, even though the temperature of the rotary anode bearing is too high.

Therefore, the present invention has for its object to provide a method and an apparatus which effectively preclude overloading of the X-ray tube and which offer reproducible exposure times for the exposure of an object.

On the basis of a method of the described kind, this object is achieved with a method, which in accordance with the invention, is characterized in that, the power fed to the X-ray tube is automatically reduced to a predetermined constant fraction of the power each time permissible, the power reduction taking place during the intervals between exposures, the anode disc temperature being compared with a second limit value which is higher than the first limit value, the tube power being reduced to a second predetermined constant friction, preferably the value zero, when the anode disc temperature exceeds the second limit value during an interval between exposures, the temperature of the rotary anode bearings being continuously determined and compared with a third limit value, the exposure being inhibited for as long as the bearing temperature determined exceeds the third limit value.

Thus, the electric power applied to the X-ray tube is automatically reduced to a fixed fraction of the permissible power each time by automatic control of the control members for the tube current and possibly for the tube voltage. The permissible power is the power with which the X-ray tube can still be operated at the temperature corresponding to the first limit value without the X-ray tube being overloaded by melting phenomena in the focal path. For an exposure duration of 0.1 s or less, the permissible power amounts to 50 kW for a 50 kW tube; when the exposure duration increases, the permissible power must decrease accordingly, and also of course the fraction of this permissible power which is applied to the X-ray tube when the anode disc temperature exceeds the first limit value.

The power reduction does not take place during an exposure, but during the intervals between exposures. When the next exposure commences only after the anode disc temperature has decreased below the first limit value again, the power applied to the X-ray tube is automatically increased to the value each time permissible, like in the known methods. The introduction of a second limit value for the anode disc temperature ensures that the X-ray tube cannot be overloaded by the reduced power. The second limit value and the fraction whereto the power is reduced, therefore, must be adapted one to the other so that the X-ray tube can be loaded with the said fraction of the permissible power at the second limit value without being damaged.

Because the temperature of the rotary anode bearing is also continuously determined and compared with a permissible bearing temperature, it is ensured that the X-ray tube cannot be destroyed when the electric power applied per exposure is comparatively low but the mean value in time of the power applied to the X-ray tube during the individual exposures and fluoroscopic operations is comparatively high, in which case the second limit value of the anode disc temperature usually is not reached. However, it may occur in some cases that, before the bearing temperature reaches the third limit value, the joint (for example, a soldered joint) between the rotor and the shaft on which the anode disc is accommodated exceeds a critical value. Instead of the bearing temperature, the temperature at this joint must then be monitored. In both cases the applied electric power, averaged over a period of time of a few minutes, may not exceed a limit value.

An apparatus in accordance with the invention is characterized in that, said apparatus further comprises:

means for generating a bearing-temperature signal indicative of the temperature of the rotary anode bearing temperature, further comparator means for comparing the anode-temperature signal with a second limit value, which is larger than the first limit value, and for comparing the bearing temperature signal with a third limit value, thereby generating a second and a third reduction signal respectively, said second and third reduction signal are applied to the control means for further reducing the X-ray tube load to a predetermined level or to inhibit any load respectively.

In an elaboration of the invention, the first limit value corresponds to the temperature approximated by the anode disc in the case of prolonged loading with a mean fluoroscopic power. This elaboration is based on the fact that the loadability of a tube, for example 50 kW (during 0.1 s or less) in a 50 kW tube, is not the maximum permissible power in the case of a cold anode disc (in the case of a cold anode disc, a higher load is possible), but the power which is still permissible without damaging of the anode disc after prolonged fluoroscopy during which the anode disc may have reached a temperature of a few hundreds of degrees centrigrade. Thus, the first limit value of the anode disc temperature is 500° C. or higher, depending on whether the anode disc is roughened or blackened (in which case the anode disc dissipates a higher power and thus remains cooler) or not.

When the power is reduced by reducing only the tube current, the images recorded with the power thus reduced maintain their character, but the exposure time has to be increased when the same density or the same mAs product is to be reached. However, prolongation of the exposure time not permissible is in many cases, for example, in the case of planigraphy where a given exposure time is prescribed. According to an elaboration of the invention, therefore, the power is reduced by increasing the voltage on the X-ray tube by a predetermined fraction and by reducing the tube current at the same time by a fraction which is three to five times larger. The electric power applied to the X-ray tube is then reduced, but the dose power generated by the X-ray tube is not reduced. This is because the dose power varies linearly with the tube current, but with the third to fifth power of the voltage, so that the tube current reduction with respect to the dose power is compensated for by the increase of the voltage of the X-ray tube. Because the dose power thus remains approximately constant, the same exposure time can be used even in the case of a dose variation; however, the exposure character changes due to the variation of the voltage on the X-ray tube.

The invention will be described hereinafter on the basis of an embodiment which is shown in the drawing.

Figure 1:
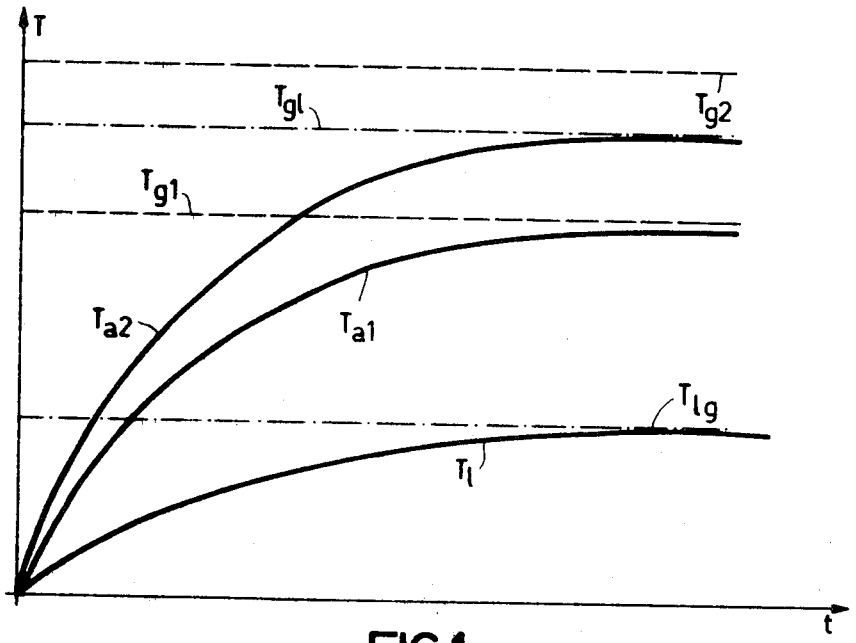
FIG. 1 shows the various limit values of the temperature.

FIG. 1 shows the variation in time of the various temperatures. The reference $T_{g1}$ denotes the first limit value of the anode disc temperature. This limit value of the anode disc temperature is the value which is asymptotically approximated by the anode disc temperature when the disc is loaded with a mean fluoroscopic power, for example 250 W. Customary X-ray tubes are constructed, so that at this limit value they can handle the power for which they are intended (for example, 30 kW during 0.1 s or less for a 30 kW tube) without being overloaded. The second limit value is denoted by the reference $T_{g2}$. This value is chosen so that the X-ray tube will not be overloaded when the anode disc temperature corresponds to this limit value and the X-ray tube receives approximately 80% of the electric power permissible at the first limit value of the anode disc temperature.

The reference $T_{a2}$ denotes the temperature of the anode disc as a function of time which occurs when the X-ray tube constantly receives the electric power which is permissible without leading to destruction of the tube bearings. It tends to a limit value $T_{g1}$ which is situated between the first limit value $T_{g1}$ and the second limit value $T_{g2}$. The latter two limit values amount to 730° C. and 1050° C., respectively, in a typical X-ray tube without roughening or blackening of the anode disc or rotor faces. The reference $T_1$ denotes the variation of the temperature in the bearing when the X-ray tube is loaded with the said power. The bearing temperature in this case asymptotically tends to a limit value $T_{1g}$. When the anode disc temperature corresponds to the limit value $T_{g1}$ or is below this value at the start of an exposure, the X-ray exposure is performed with the full power permissible for this temperature. When the anode disc temperature is between the limit values $T_{g1}$ and $T_{g2}$ during an interval between exposures, the power is reduced, i.e. the adjusting members for the tube voltage and the tube current are controlled so that the electric power amounts to exactly 80% of the electric power permissible below the limit value $T_{g1}$. When the anode disc temperature determined during the interval between exposures drops below the first limit value again, the electric power which can be applied is increased to the full value again. When the anode disc temperature exceeds the second limit value during an interval between exposures, the exposure is inhibited until the temperature has dropped at least below the value $T_{g2}$ again.

It appears from the diagram of FIG. 1 that not in all cases where the anode disc temperature is between the limit values $T_{g1}$ and $T_{g2}$ an exposure can be performed, not even with reduced power, because it may be that the bearing temperature has reached the permissible limit value, without the anode disc temperature having exceeded the second limit value. In accordance with the invention, overloading of the X-ray tube is prevented by determination of the bearing temperature and the inhibition of the exposure when the limit value $T_1$ of the bearing temperature is reached. In the known methods, where the electric power applied to the X-ray tube is automatically reduced beyond a limit value of the anode disc temperature, this is not the case, unless it is ensured that the anode disc temperature cannot exceed the value $T_{g1}$ between the two limit values $T_{g1}$ and $T_{g2}$; however, the load reserves then still available will not be fully utilized.

It is not useful to choose the second limit value $T_{g2}$ to be essentially higher, because the power must then be reduced to a significantly greater degree in the range between these limit values (for example, to 50% of the power permissible below the first limit value $T_{g1}$) and because the increased temperature range in which exposures can be performed with reduced power cannot be used in practice, because the bearing temperature $T_1$ generally reaches its limit value before the second limit value thus increased is reached.

Figure 2:
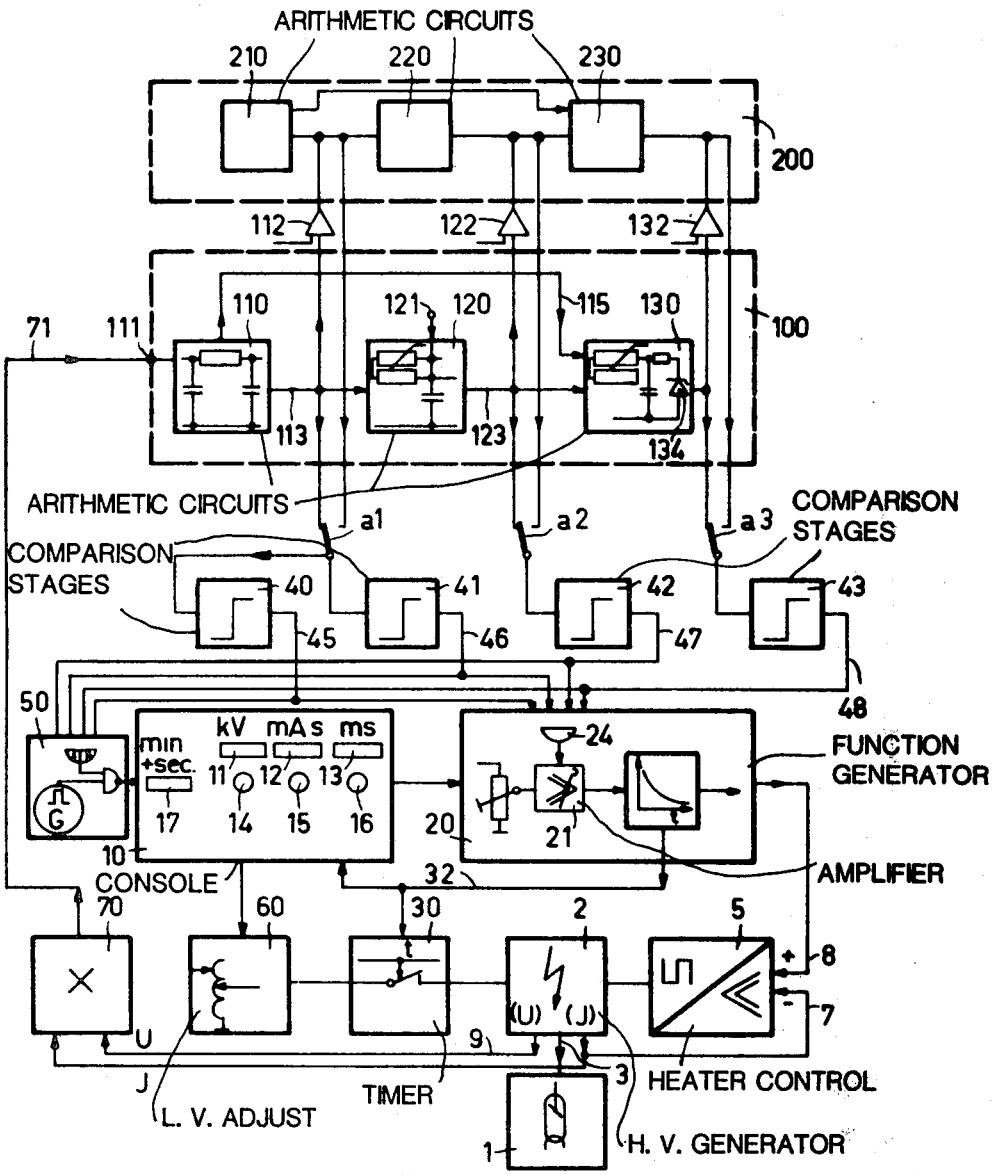
FIG. 2 shows the block diagram of an arrangement for performing the method in accordance with the invention.

The block diagram of FIG. 2 shows an X-ray generator for performing the method in accordance with the invention. A rotary anode X-ray tube 1 is connected to a high voltage generator 2. Via a timer 30, the generator is connected to a low voltage adjusting member 60. The electronically controlled heating circuit 5 receives its reference value, via a line 8, from a function generator 20 for the tube nomograms, which in its turn receives the adjusting signals from the generators 14, 15, 16 arranged on the control console 10, for inputting the exposure parameters (tube voltage, tube current, exposure time). The function generator 20 serves in known manner to generate the tube load nomograms for the various X-ray tubes, and possibly for different focal spots within the individual X-ray tubes, but each time for only one exposure. Thus, the function generator 20 supplies a signal which at any instant represents, for the X-ray tubes and the focal spot thereof to be used for an exposure, a signal which at this instant corresponds to the permissible tube current, and hence the electric power, and which appears as a reference value on the line 8. It may concern a signal which constantly decreases after a starting period (0.1 s) for an X-ray exposure with constantly decreasing power, or a signal having a constant value, for example, when an exposure with constant current is adjusted on the control console 10.

Figure 2A:
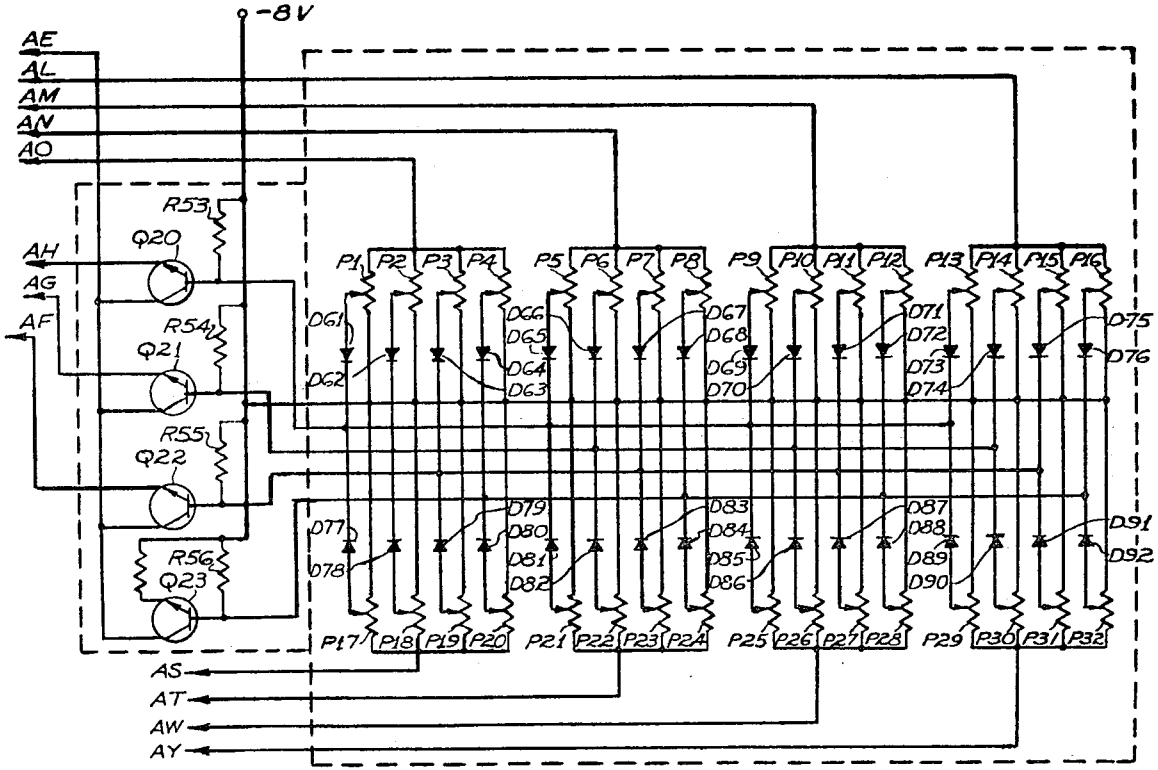

German Offenlegungsschrift 21 58 865 describes a circuit (FIG. 2*a*) which is sutable for use as the function generator 20. It includes a time limit adjustment circuit having eight input terminals AL, AM, AN, AO, AS, AT, AW, AY which each are connected to the stationary contacts of a set of four potentiometers.

Thus, input terminal AO is connected to the commonly connected stationary contacts of a set of four potentiometers P1, P2, P3, P4; the input terminal AN is connected to the stationary contacts of a set of potentiometers P5, P6, P7, P8; the input terminal AM is connected to the stationary contacts of a set of four potentiometers P9, P10, P11, P12; and the input terminal AL is connected to the commonly-connected stationary contacts of a set of four potentiometers P13, P14, P15, P16.

Similarly, the input terminal AS is connected to the commonly connected stationary contacts of a set of four potentiometers P17, P18, P19, P20; the input terminal AT is connected to the commonly-connected stationary contacts of a set of four potentiometers P21, P22, P23, P24; the input terminal AW is connected to the commonly-connected stationary contacts of a set of four potentiometers P25, P26, P27, P28; and the input terminal AY is connected to the commonly-connected stationary contacts of a set of four potentiometers P29, P30, P31, P32. The other stationary contacts of the potentiometers P1, P2, P3, P4 are respectively connected to the other stationary contacts of the potentiometers P17, P18, P19, P20. Similarly, the other stationary contacts of the potentiometers P5, P6, P7, P8 are respectively connected to the other stationary contacts of the potentiometers P21, P22, P23, P24. In a like manner the other stationary contacts of the potentiometers P9, P10, P11, P12 are respectively connected to the other stationary contacts of the potentiometers P25, P26, P27, P28. Finally, the other stationary contacts of the potentiometers P13, P14, P15, P16 are respectively connected to the other stationary contacts of the potentiometers P29, P30, P31, P32.

The movable contacts of the potentiometers P1 to P32 are respectively connected to the anodes of a corresponding number of diodes D61–D92. Also, the cathodes of the diodes D61 to D76 are respectively connected to the cathodes of diodes D77 to D92.

A tube limit curve generator 18 includes four NPN transistors Q20, Q21, Q22, Q23 having their collectors connected in common to an output terminal AE. The base terminal of the transistor Q20 is connected through a resistor R53 to a negative 8 volt supply source and is also connected to the cathodes of diodes D61, D65, D69, D73. Similarly, the base of transistor Q21 is connected through a resistor R54 to the negative 8 volts supply source and is also connected to the cathodes of the diodes D62, D66, D70, D74. In a like manner, the base of the transistor Q22 is connected through a resistor R55 to the negative 8 volt supply source and is also connected to the cathodes of the diodes D63, D67, D71, D75. Finally, the base of transistor Q23 is connected through a resistor R56 to the negative 8 volt supply source and is also connected to the cathodes of diodes D64, D68, D72, D76.

The negative 8 volt supply source is coupled directly to all the junction points between the series connected potentiometers P1 to P32. The emitters of the transistors Q20, Q21, Q22 provide the output terminals AH, AG, AF, respectively.

The actual values of the tube current I required for tube current control are supplied by a measuring transducer which is included in the high voltage generator. The reference value is applied to the line 8 via an amplifier 21, whose gain can be controlled in steps and which is included in the function generator 20. The gain of this amplifier always remains constant during an exposure.

When the X-ray generator operates with an automatic exposure device, only the tube voltage is adjusted on the control console 10. Therefrom, and from the tube power, the function generator determines the tube current which is required for this power and which decreases in the time ("decreasing load"), this value being applied, via the amplifier 21, to the line 8 for the reference value of the tube current control circuit. Thus, the magnitude of the reference values is not only dependent of the adjusted value and the tube power, but also of the adjusted gain of the amplifier 21.

The same is applicable to the mode "two-button control" where the mAs product is adjusted in addition to the tube voltage. However, the resultant exposure duration is then also dependent of the gain. This value, formed in known manner in the function generator 20, is applied, via the line 32, on the one hand to the indicator 13 on the control console 10 and on the other hand to the timer 30.

Figure 2B:
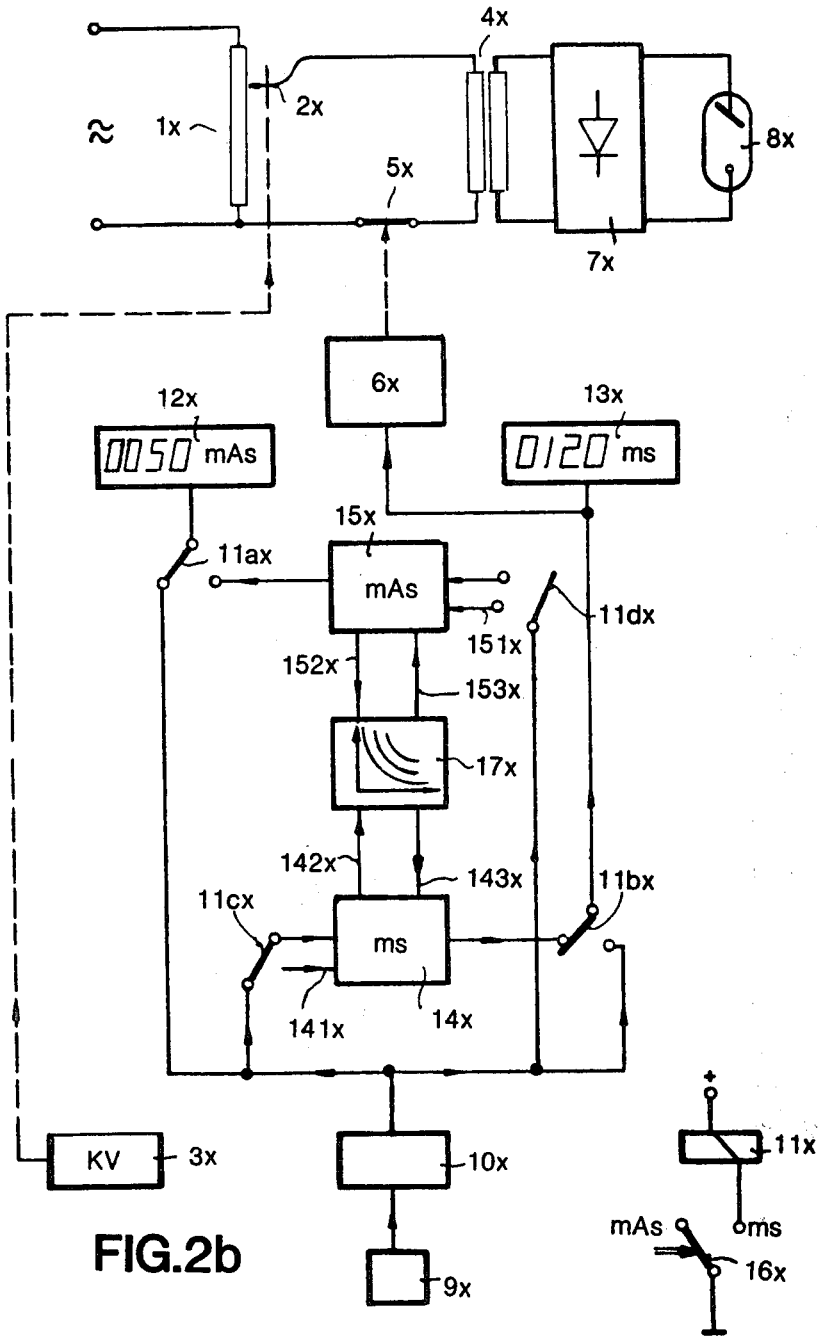

The function generator 20 can determine the value in the manner described in German Offenlegungsschrift 27 21 535. FIG. 2*b* corresponds to the drawing in that Offenlegungsschrift. The arithmetic units 14*x* and 15*x* can be designed as address arithmetic elements which allocate the particular address to every combination of exposure voltage and focal spot size (these values are entered by the inputs 141*x* or 150*x* ) and the exposure time or mAs product (these values are entered by the changeover switch 11*cx* or 11*dx*). Via an address line 142*x* or 152*x* the arithmetic unit 14*x* or 15*x* calls up the corresponding addresses of the normal nomogram store 17*x* in which the exposure time value to be allocated to this combination or the mAs product is stored at the storage location addressed. The value read from the storage location addressed is applied via to line 143*x* or 153*x* to the arithmetic unit 14*x* or 15*x* and appears at its output.

Since, in each of the two modes of operations, only one of the two arithmetic units is used, it is not necessary for two computers to be used—as shown in the diagram provided as an aid to comprehension. Instead, a single arithmetic unit is sufficient, to which the value entered with the input device 9 is constantly applied, so that the changeover switch 11*cx* or 11*dx* can be omitted. In this case, however, a signal additional to that allocated to the chosen mode of operation (mAs switch mode or time-switch mode) must be given to the arithmetic unit, the output of which is then—depending on the mode of operation selected—connected to either of the indicating units 12*x* or 13*x*, while the entered value is fed directly to the other indicator unit. Other known, e.g. analog, arithmetic units can also be used to determine the resulting mAs value or the resulting exposure time; in the latter case, however, analog input of the mAs product of the exposure time is then required.

The gain of the amplifier 21 is controlled in dependence of the temperature of the anode disc, of the anode bearing and of the X-ray tube housing.

Figure 2C:
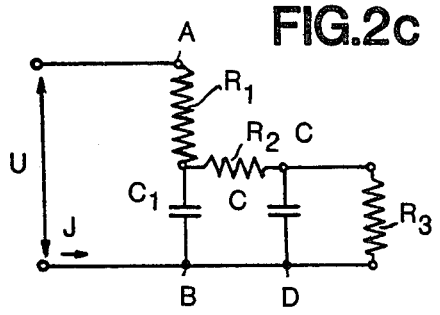
Figure 2D:
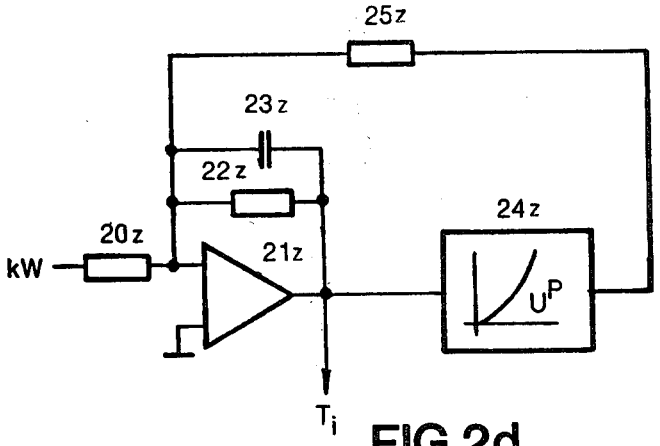

These temperatures are determined in the device 100 which comprises three arithmetic circuits 110, 120, 130. The circuit of FIG. 2*c* is suitable for use in the arithmetic circuit of FIG. 110. The circuit comprises a network of three resistors $R_1$, $R_2$, $R_3$ and two capacitors, $C_1$ and $C_2$ in order to produce a value, which is always largely proportional to the temperature of the focal area of the anode. The resistor $R_1$ is connected in series with the capacitor $C_1$ at the input terminals of the circuit; the resistor $R_2$ and the capacitor $C_2$ are connected in series to each other and parallel to the capacitor $C_1$, the capacitor $C_2$ being bridged by the further resistor $R_3$. This resistor $R_3$ is essential for the most accurate possible assessment of the time lag of the temperature of the part of the anode body lying outside the immediate vacinity of the focal spot and hence also for the accuracy of the indicating of the particular focal spot temperature. This device is connected to a current source in such a way that when the X-ray tube is operated, a direct current J which is proportional to the electric power supplied by the X-ray tube flows through the device. This electric power corresponds to the product $V_mA_m$ (where $V_m$ and $A_m$ represent the arithmetic means of the voltage fed to the X-ray tube and of the current), if a rectifier unit with four diodes is used to product the operating voltage of the X-ray tube; it is 1.35. $V_m \cdot A_m$ if a rectifier unit with six diodes is used. The power also corresponds approximately to the larger value in the case of a rectifier unit with four diodes, if the connecting cables between the unit supplying the direct current and the X-ray tube are fairly long, so that they can store electric energy and consequently cause a smoothing of the voltage.

Under these conditions there occurs at the input terminals A and B of the monitoring circuit a voltage U which rises steeply when the tube is first switched on and then more slowly. This voltage U can be used as a criterion for the temperature of the anode or target when determining the values of the resistor $R_1$, $R_2$, $R_3$ and the 2 capacitors $C_1$ and $C_2$ taking into account known rules for forming an electrical image in the thermal behavior of the composite body. The behavior of the voltage U is a function of time then adapts with great accuracy to the temperature of the focal area shown in the time verses temperature diagram. The fact that a certain limit value of the voltage U is reached indicates that the permissable load limit of the X-ray tube has been reached.

To this end, the input 111 of the arithmetic circuit 110 receives via a lead 71, a signal which represents the instantaneous value of the electric power applied to the X-ray tubes and which has the value zero during an interval between exposures or fluoroscopic operations. The signal is generated by a multiplexer 70 which forms the product of the tube voltage (U) and the tube current (I) during the exposure or the fluoroscopy. The components used in the arithmetic circuit 110 are proportioned in accordance with the thermal parameters of the anode disc of the X-ray tube; when use is made of several X-ray tubes or one X-ray tube comprising several focal spots, these components must be switched over accordingly. The voltage appearing on the output 113 approximately represents the relevant anode disc temperature. It is applied on the one hand to the input of a second arithmetic circuit 120 for simulating the rotary-anode bearing temperature, the elements thereof also being adjustable to the thermal parameters of the X-ray tube, and on the other hand to the inputs of two comparison stages 40 and 41 which are activated when the value supplied by the arithmetic circuit 110 corresponds to the first limit value $T_{g1}$ or the second limit value $T_{g2}$, respectively.

The arithmetic circuit 120 is designed so that, when via the lead 71 there is constantly supplied a signal which corresponds to the continuous power still permissible in view of the bearing heating, the output signal of the arithmetic circuit 120 tends to a limit value which corresponds to the limit value $T_{1g}$. This signal, present on the line 123, is applied to the input of a further comparison device 42 which is activated as soon as the said limit value is reached. In addition, the arithmetic circuit 120 may comprise an input 121 which receives, in reaction to starting or braking of the rotary anode, a current which covers the component of the starting or braking power which is transferred to the rotor by induction.

The output signal of the arithmetic circuit 120 is applied to the input of a third arithmetic circuit 130 which simulates the housing temperature, said output signal corresponding to the heating power at the prevailing heat transmission resistors. Moreover, via the line 115, the arithmetic circuit 130 is connected to the arithmetic circuit 110 wherefrom it receives a signal which corresponds to the heat power radiated by the anode disc. The output of the arithmetic circuit 130 for the housing temperature is connected to the input of a fourth comparison stage 43. The ambient temperature can be simulated by a voltage source (variable or not) which is realized in the simplest case by a suitable Zener diode 134. The output of the arithmetic circuit 130 is connected to a fourth comparison stage 43 which is activated when the voltage of the output corresponds to a predetermined limit value of the housing temperature.

The arithmetic circuit 130 may be replaced by a suitable temperature sensor which measures the housing temperature. The arithmetic circuits 110 and 120 can in principle also be replaced by temperature sensors which measure the anode disc temperature and the bearing temperature, respectively, but such a measurement is essentially more difficult than the simulation or calculation of the corresponding temperatures.

The outputs 45, 46, 47 and 48 of the comparison stages 40, 41, 42 and 43, respectively, are connected to control inputs of the function generator 20 and control, via a suitable switching network, the gain of the variable gain amplifier 21. This control, which is effective only during the intervals between exposures, is such that the gain is adjusted to zero when at least one of the comparison stages 41, 42 or 43 is activated, i.e. when the anode disc temperature has exceeded the second limit value $T_{g2}$, when the bearing temperature has exceeded its limit value and/or when the limit temperature of the housing has been exceeded. However, if only the comparison stage 40 is activated, i.e. if the anode disc temperature exceeds the first limit value $T_{g1}$ without any of the other three comparison stages 41, 42, 43 being activated, the gain of the variable gain amplifier 21 is adjusted to 80%. This means that the reference value for the tube current is reduced to 80% of the value below the first limit value still permissible for the given setting on the control console 10 and the given loadability of the X-ray tube. In the case of timer controlled operation, at the same time the exposure duration is changed and, via the signal connection 32, the timer 30 and the indicator 13 on the control console are set for the changed value of the exposure duration. At the same time the operator can be informed, for example, by the flashing of the indicator or by another signal, that the power has been reduced. When none of the four comparison stages is activated, the gain amounts to 100% of a rated value, i.e. the reference value produced by the function generator corresponds to a tube current where the power of the X-ray tube is fully utilized.

When one of the comparison stages 40 to 43 detects that a limit temperature is exceeded, a fast simulation in a quickened mode is started, for example, as known from German Offenlegungsschrift 23 45 947, by means of a second simulation network. A suitable circuit for the simulation network is shown in FIG. *2d*. An input signal which is proportional to the power applied to the X-ray tube is applied, via a resistor 20*z*, to an operational amplifier 21*z* having a very high input resistance. The output of the operational amplifier is connected to its input via the parallel connection of a resistor 22*z* and a capacitor 23*z*. Moreover, the output of the operational amplifier 21*z* controls an involution circuit 24*z*, the output of which involutes the input signal with an exponent p. The output signal of the involution circuit 24*z* is applied to the input of the operational amplifier 21*z* via a resistor 25*z*. The involution circuit 24*z* solves the generated heat dissipation equation:

$$dT/dt = K_1 . T - K_2 . T_p;$$

in which by suitable proportioning of the individual elements, the constants $K_1$ and $K_2$ and the exponent p can be made to take into account the heat conduction, storage and radiation properties of the anode. The output signal of the operation amplifier 21*z* is thus caused to vary in a similar manner of the temperature of the anode. The second network 200 also comprises three arithmetic circuits 210, 220, 230 whose design is identical to the design of the arithmetic circuits 110, 120 and 130, respectively, but whose time constants deviate from those of the arithmetic circuits 110, 120 and 130 by a constant factor which is substantially larger than 1. When one of the comparison stages 40 to 43 is activated, a fast simulation cycle is started during which the arithmetic circuits are set, via the voltage amplifiers 112, 122, 132, to the (real time) temperature determined by the arithmetic circuits 110, 120 and 130, after which they simulate the cooling process. During this fast simulation, the comparison stages 40 to 43 are connected to the output of the simulation network 200 via switches $a_1$ to $a_3$. Simultaneously with the fast simulation cycle, a gate is opened in the circuit 50 so that a generator can increment a waiting time counter with indicator 17 on the control console with a frequency which is adapted to the quick-motion factor. As soon as the values in the simulation network 200 drop below the limit temperatures again, the waiting time counter contains the waiting time which has to expire before an exposure can be executed with 100% of the power again. The waiting time counter is decremented in real time, so that the actual waiting time is indicated at any instant.

The simulation network 100, the simulation network 200, the comparison stages 40 to 43 and the function generator 20 are preferably realized by means of a microprocessor. The calculation of the various temperatures in real time and in quickened mode operation is then particularly simple, because for the quickened mode operation the calculating steps only have to be executed in a succession which is faster than the speed corresponding to the time increment used for the real time calculation of the temperatures; the time increment, moreover, can be chosen to be larger for the quickened mode simulation.

Figure 3:
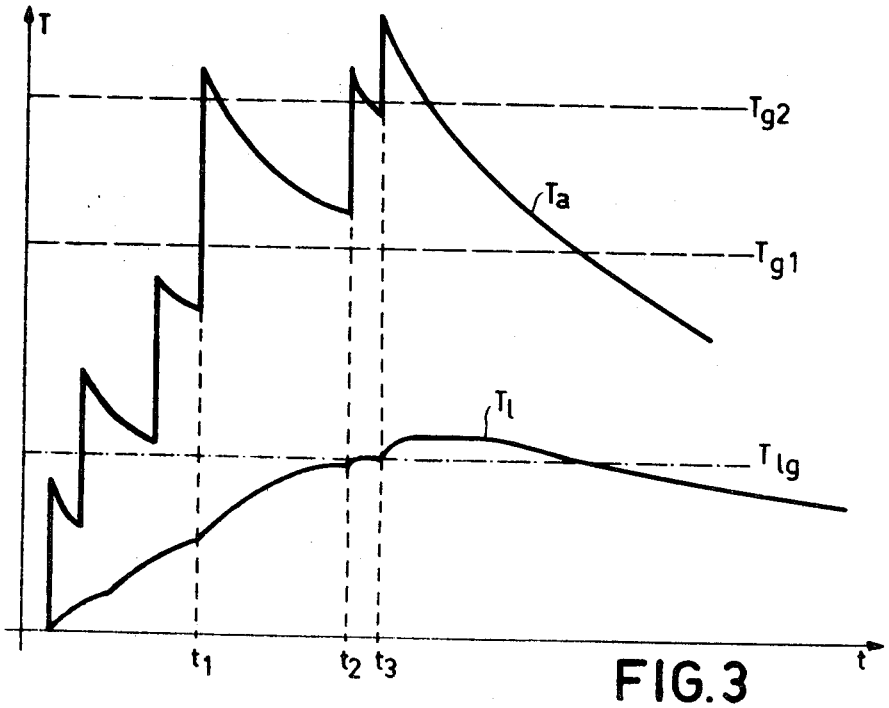
FIG. 3 shows the variation of the temperature during a prolonged X-ray examination.

FIG. 3 shows the variation in time of the temperature $T_a$ on the anode disc and the temperature ($T_1$) on the bearing of a rotary-anode X-ray tube during a typical X-ray examination. During each exposure, the temperature $T_a$ of the anode disc increases almost step-wise (actually, the temperature increase per unit of time is proportional to the instantaneous value of the power applied to the X-ray tube), the magnitude of the step being dependent of the energy applied during an exposure. It can be seen that the temperature of the anode disc decreases approximately exponentially during the intervals between exposures, but essentially slower than the increase during an exposure. During a certain exposure at a time $t_1$, the temperature $T_a$ of the anode disc exceeds the first as well as the second limit value, $T_{g1}$ and $T_{g2}$, respectively. Consequently, the comparison stages 40 and 41 are activated and a fast simulation cycle is started; via the indicator 17 on the control console, the operator is informed how long he has to wait until a next exposure can be performed with full power. After the anode disc temperature has dropped below the second limit value $T_{g2}$ again, the comparison stage 41 returns to the rest condition, i.e. the inhibition of the exposure is removed and only the comparison stage 40 remains activated, so that an exposure can be performed, be it with a power reduced to 80%. After the next exposure (started at a time $t_2$), performed with 80% of the rated power because the temperature has not yet dropped below the first limit value $T_{g1}$ at the beginning of this exposure, the anode disc temperature $T_a$ again exceeds the second limit value, so that the comparison stage 41 is activated and the comparison stage 40 remains in the activated condition. During the second next exposure, at a time $t_3$, the second limit value $T_{g2}$ is again clearly exceeded, so that the exposure again remains briefly inhibited (comparison stages 40 and 41 in the activated condition).

In comparison with the anode disc temperature, $T_a$, the bearing temperature $T_1$ changes only comparatively slowly due to the heat transmission resistances between the anode disc and the bearings. It exceeds the bearing temperature limit value $T_{1g}$ after the completion of the exposure at the time $t_3$ (the comparison stage 42 is also activated) and its temperature $T_1$ subsequently increased to a maximum value, without the X-ray tube receiving further electric power during this period. Therefore, the limit value $T_{1g}$ of the bearing temperature must be chosen slightly below the maximum permissible bearing temperature. After the anode disc temperature $T_a$ has dropped below the second limit value again, the comparison stage 41 returns to its original condition, but the comparison stage 42 remains in the activated condition. When the bearing temperature $T_1$ has dropped below the limit value $T_{1g}$ again, in principle further exposure can be performed, but this is not very efficient because the limit value $T_{1g}$ will be exceeded again in reaction to even a small exposure power. Therefore, the comparison stage 42 preferably exhibits hysteresis, i.e. it returns to its initial condition only at a bearing temperature substantially below the limit value $T_{1g}$. Several X-ray exposures can then be made again, without the comparison stage 42 being activated due to the reaching of the limit temperature $T_{1g}$.

Of course it is possible to monitor the temperature of the X-ray tube housing or of the X-ray tube cooling medium (oil) also and if such a temperature exceeds a threshold temperature it is possible to inhibit the start of exposures.

Figure 4:
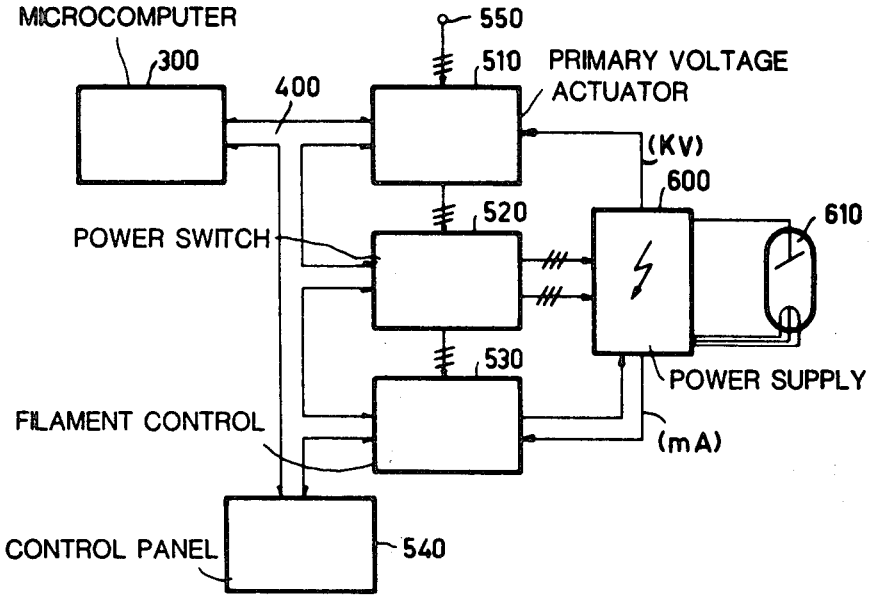
FIG. 4 shows a preferred embodiment of a tube overload protection circuit realized by use of a microcomputer.

In FIG. 4 a preferred embodiment of an X-ray tube overload protection circuit has been shown. A microcomputer 300 has been connected via a bus system 400 to a primary voltage actuator 510, a power switch circuit 520, a filament current control circuit 530 and an (X-ray operator's) control panel 540. The primary voltage actuator 510, the power switch circuit 520 and the filament current control circuit 530 have been connected to a main power supply 550. The operator's control panel 540 has pushbuttons for digital data entry and displays for various indications.

A high voltage tank 600, which comprises the high voltage transformer, rectifiers, filament insulation transformer as well as measuring circuits (not shown) for providing real kV and mA data, has been connected to the power switch circuit 520 and to the filament current control circuit 530. An X-ray tube 610 is connected to the high voltage tank 600. The measuring circuits for kV and mA in the high voltage tank 600 have outputs, which have been fed back to the primary voltage actuator 510 and to the filament current control circuit 530 respectively for closed loop control (of the filament current) and for providing real exposure data (kV), (mA) to the data bus 400.

Data concerning an X-ray exposure are entered via the panel 540 and are fetched by the microcomputer 300. Based on the exposure data the microprocessor 300 controls the voltage actuator 510 for setting the high voltage, the power switch circuit 520 for switching on and off the X-ray tube 610, and the filament control circuit 530 for controlling the X-ray tube filament current.

Figure 5:
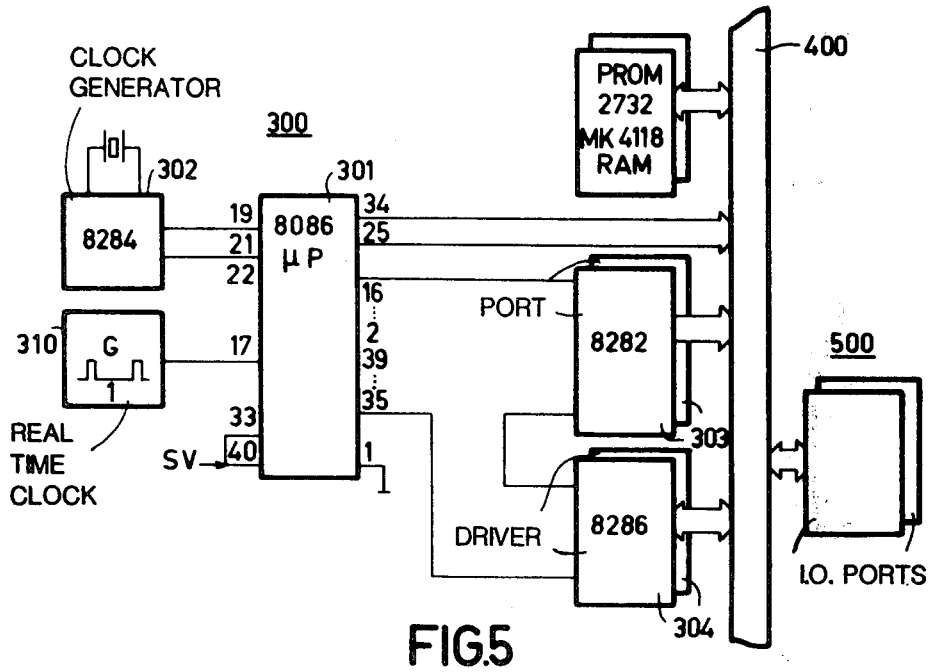
FIG. 5 shows the main functional set up of the microcomputer and FIGS. 6 to 9 show flow charts of program parts to ensure X-ray tube overload protection.

In FIG. 5 the microcomputer 300 as shown in FIG. 4 has been disclosed in more detail. The microcomputer 300 comprises an Intel 8086 microprocessor 301, a clock pulse generator 302 (Intel type 8284), a real time clock 310, Intel 8282 ports 303. Intel 8286 drivers 304, a Read-Only Memory 305 and a Random Access Memory 306. An extra clock pulse generator 300 provides pulses to the interrupt entry pin 17 of the processor 301 for reasons as will be explained hereinafter. The memories 306, 305, the ports 303 and the drivers 304 have been connected to a data-address-and control bus 400, which includes control lines of the processor 301 (pins 25 and 34). The processor's 301 address-and data-signals appearing on the pins 2–16 and 34–39 of the processor in a time-multiplex way are demultiplexed with the aid of the ports 303 and drivers 304. The demultiplexed data and address are fed to the bus system 400. In cooperation with the control signals on pins 25 and 34 of the processor 301 the processors accesses the memory 305 or 306 or one of the input/output ports 500. The input-/output ports 500 comprise address decoding and data latching circuits (integrated circuits), from which (via digital-analog-converters) output data are sent to the primary voltage actuator 510, the power switching circuit 520, the filament current control circuit 530 or to the control panel 540. The input/output ports 500 further comprise circuitry for receiving input data, (via analog-digital convertors) such as the real X-ray tube voltage, -current and filament current, and for putting said input data on the bus 400 upon control of the processor 301.

The Random Access Memory 306 is used for storing variables and data. The Read Only Memory 305 stores the instruction sequence(s) which enables the processor 301 to control the circuitry as shown in FIG. 4 and to perform the tube overload protection according to the invention. An example of such a sequence will be described and be shown by FIGS. 6 to 10, each of which disclose a (part of a) flow chart concerning the several steps to be taken during control of the X-ray generator (as disclosed in FIG. 4). The shown flow-charts show only those aspect, which concern the invention or which are necessary to enlighten the same.

Figure 6:
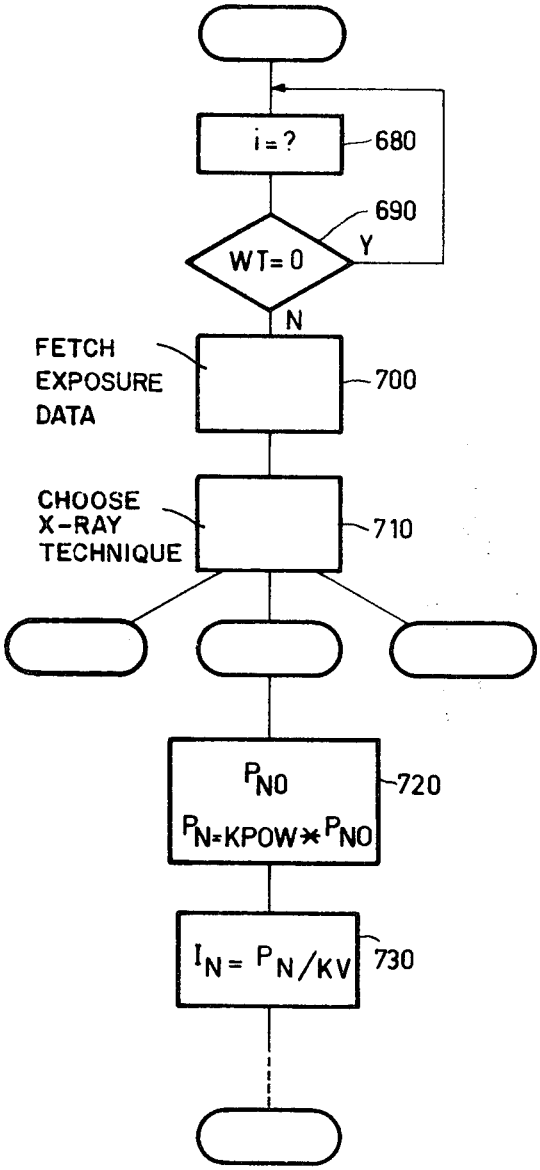

In FIG. 6 a part of the main program is shown. Sometimes after the circuitry of FIG. 4 has been switched on to the main power supply the X-ray tube index i of the exposure data, which have fed into the control panel 540 by the radiologist, is fetched by the microcomputer 300, FIG. 6 step 680.

Having entered the X-ray tube index i it is checked whether or not a waiting time WT has to pass before an X-ray exposure or examination can be carried out with the chosen X-ray tube i (step 690). If a waiting time WT exists a next exposure data may be entered via the control panel 540 to enable examinations with another X-ray tube. If no waiting time WT exists then all further exposure data are fetched by the microcomputer 300 (step 700).

Upon the kind of exposure data the microcomputer 300 branches (step 710) to a subprogram corresponding to the chosen X-ray technique, e.g. for a conventional tomography mA, kV and exposure-time are to be entered whereas for a falling load recording only KV data have to be entered. It is assumed that a falling load recording is to be made. So step 720 is carried out, which implies that for a chosen X-ray tube a load nomogram is fetched by the microprocessor 301 out of memory 305. The load nomogram provides a maximum power $P_{vo}$, which can be fed to the X-ray tube 610 without overloading the same if the X-ray tube 610 has a cold anode (is not used immediately before). The maximum power $P_{no}$ is multiplied by a factor KPOW in microprocessor 301. The factor KPOW depends on the state (cold, hot, overheated) of the X-ray tube's anode, of the anode's bearing or of the tube's housing as will be clarified hereinafter. In the next step the modified Power $P_N = P_{NO} \times KPOW$ is used to calculate the X-ray tube's anode current and filament current, which data together with the KV chosen by the radiologist are used to control the high voltage-generator circuit 510, 520, 530, 600 of FIG. 4.

Figure 7:
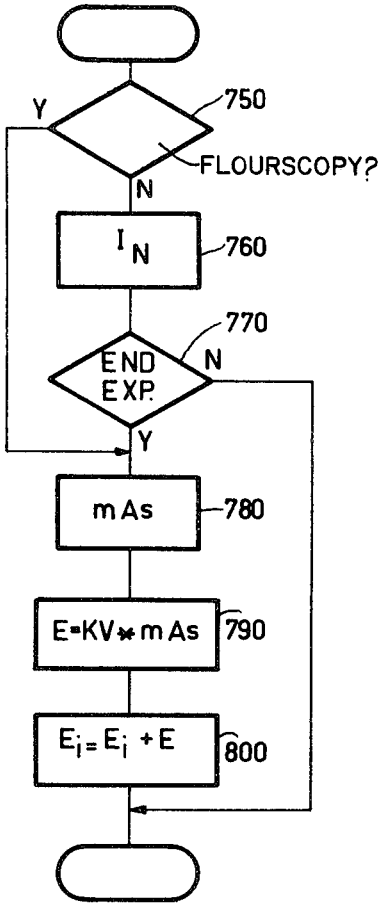
Figure 8:
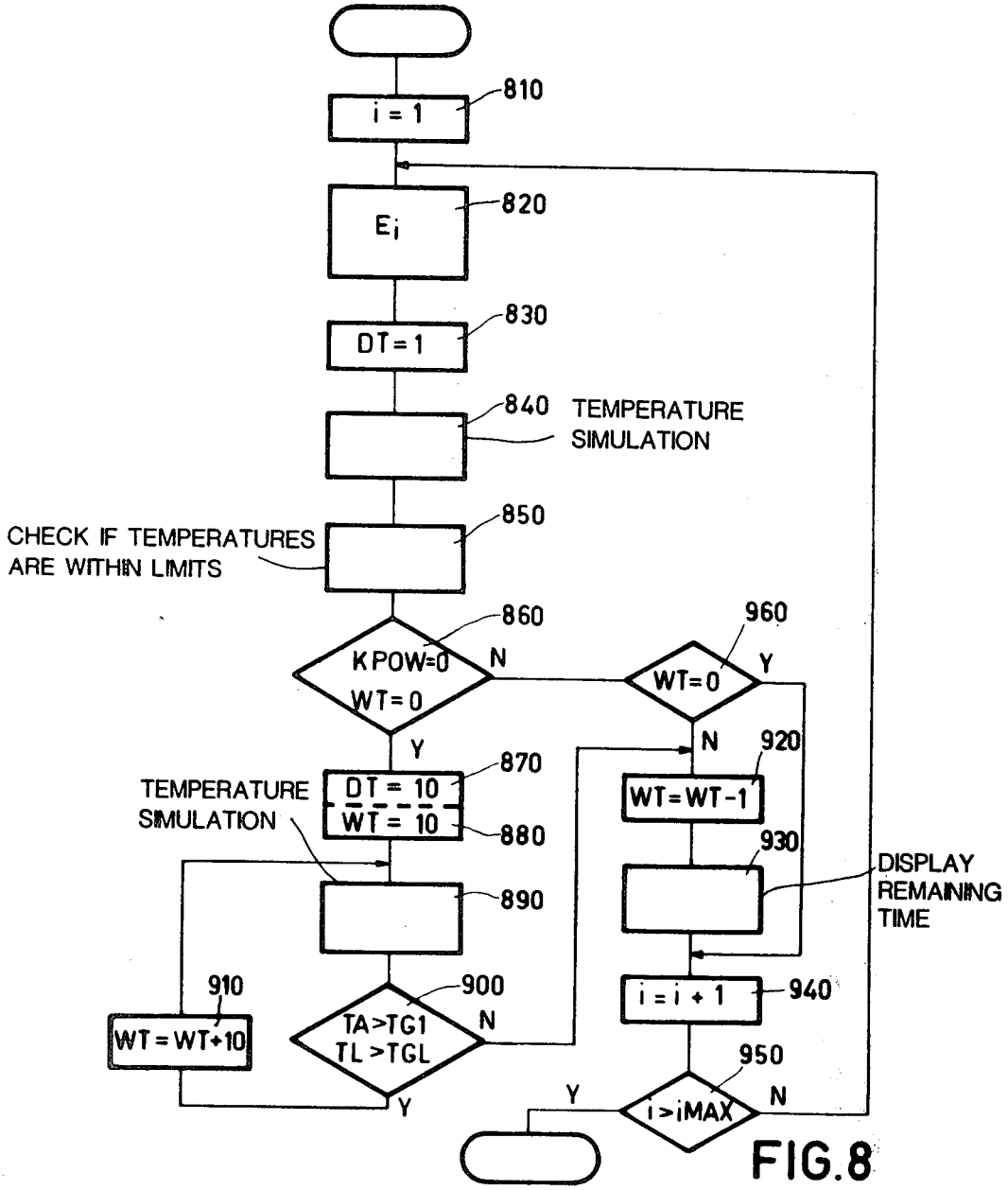

In FIG. 7 the CONTROL program has been shown in a flow chart. In a first step 750 of the program it is checked whether or not a fluoroscopy examination is to be carried out. If not the first data concerning the magnitude of the filament are fed to circuit 530 (step 760). Next is checked whether or not the exposure is terminated (770) if not then via RETURN the program is lead back to the steps 750 and 760 to feed the next data concerning the filament current to circuit 530. In other words the CONTROL program provides filament current's set points at regularly intervals, determined by the real clock 310, as long as the exposure lasts. Except for fluoroscopy the factor KPOW is used to "monitor" the power fed to the X-ray tube.

After the exposure (FIG. 7, step 77 EXPOS.END) or termination of a fluoroscopy examination a mAsec value, which has been measured e.g. by the filament current control circuit 530, will be entered by the microprocessor 301 (step 780) and thereafter be multiplied by the X-ray tube voltage (KV, measured by circuit 510) for calculating the electric load E fed to the tube (step 790). The load E thus calculated will be added to the tube's energy quantity Ei, which is a measure for the amount of energy stored in the X-ray tube's anode disc after each examination/exposure.

The factor KPOW, which is initially set to 1 for feeding maximum permissible power to the X-ray tube 610, is determined by a sub-program called "Temperature Simulation". The program is started every second by a pulse of the real time clock 310 via a specific interrupt pointer of the microprocessor 301. As a result every second the "Temperature Simulation" (shown in flow diagram in FIG. 8) is called.

As X-ray generators often comprise more than one X-ray tube the Temperature Simulation program is run once for every tube, indicated by index i (step 810 and 940). If for all tubes (iMAX) the Simulation program has been run (test on 950) the Simulation program is left and the microprocessor 301 returns to the main program. In the step 820 next to the index-step 810 the microprocessor 301 fetches the X-ray tube's parameters and the tube energy quantity $E_i$. In correspondence to the interrupt cycle (clock 310) a time increment DT is set to 1 second (step 830). Thereafter (step 840) the temperature simulation is carried out. The rotary anode temperature TA is calculated as well as the rotary anode bearing temperature TL according to the following equations:

$$TA = TA + (E_i - DT * (K * (TS \uparrow 4 - TO \uparrow 4) + LAM * (TA - TR))) / (CS + DT * 2 * K * TS \uparrow 3)$$

$$TL = TL + DT * LAM * (TA - TL) / CR + - DT * (TR - TO) / TAM$$

wherein:

TA=Rotary Anode Temperature
$E_i$=Amount of Energy fed to the Anode
DT=Time-increment
K=Heat Radiation Coefficient
TS=X-ray Tube Shield Temperature
TO=Ambient Temperature of X-ray tubes
LAM=Heat Conduction Coefficient: Anode→Rotor
TR=Rotor Temperature
CS=Heat Storage Capacity of Anode
TL=Rotary Anode Bearing Temperature
CR=Heat Storage Capacity of Rotor System
TAU=Rotor—to Shield Cool-down Coefficient.

Having calculated the occurring rotary anode temperature TA and the rotary anode bearing temperature TL the temperatures will be checked whether they ly within permitted boundaries or not (step 850).

Figure 9:
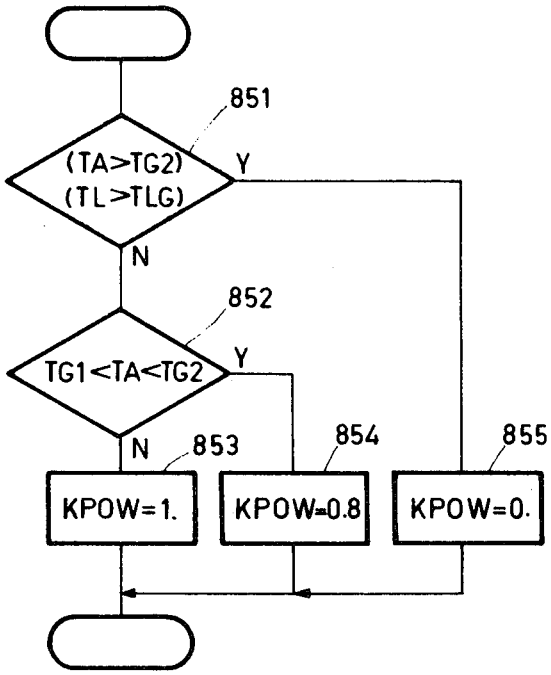

In FIG. 9 this has been shown more in detail.

If the rotary anode temperature TA exceeds the second temperature limit $TG_2$ or the rotary anode bearing temperature $T_L$ exceeds a maximum permissible bearing temperature TLG (step 851) the factor KPOW will be set to zero. If not then is checked whether the temperature TA lies between the first and second temperature limits TG1 and TG2 respectively. If so then the factor KPOW is set to 0.8, otherwise the factor is set to 1. Having determined the factor KPOW it is determined if a waiting time WT is due in step 860. If KP is zero and a waiting time WT is zero, a new waiting time WT is to be calculated. So in the next step 870 the time increment DT is set to 10 (seconds). A waiting time buffer is initialized (step 880). Then a temperature simulation is carried out again (step 890, which is identical to step 840), but by this time the time increment DT is 10 (seconds) and a quick mode simulation is carried out. In the next step 900 it is checked whether the quick mode simulated temperatures (TA, TL) exceed any temperature limit (check TA<TG1 or TL<TLG). If true the waiting time buffer content WT is increased by 10 seconds (step 910). Thereafter the program will run from the temperature simulation step 890 again and again until the quick mode simulated temperatures TA or TL do not exceed their limits any more (step 900). Then the waiting time in the buffer is decreased by 1 second (step 920) and the remaining wait time will be displayed (step 930). Thereafter the tube index i is increased by 1 in order to decide in a next step 950 whether for all X-ray tubes a temperature simulation (and a waiting time calculation) has been carried out. If not the subprogram will start at step (820) for the next X-ray tube. If yes then a return to the main program is due.

If the factor KPOW is not zero (step 860) then it will be checked if the waiting time buffer is empty (WT=0 step 960). If not the waiting time WT is decreased by 1 second (step 920). If yes the sub-program continues at step 940 (change of the X-ray tube's index i.)

The results of the temperature simulation and calculation of factor KPOW and of the waiting time TW determine whether or not an X-ray tube can be used for an exposure or for an examination. If an X-ray tube can be used the factor KPOW controls the percentage of permissible power to be fed to the X-ray tube. The method and apparatus as described herein before thus give a secure X-ray tube overload protection.

What is claimed is:

1. A method of controlling the electric power applied to a rotary anode X-ray tube in an X-ray generator in dependency of the anode temperature of the X-ray tube which includes the steps of continuously determining the anode disc temperature, comparing said temperature with a first limit value and automatically reducing the electric power applied to the X-ray tube when the anode disc temperature exceeds the first limit value, the improvement comprising automatically reducing the power fed to the X-ray tube to a permissible predetermined constant fraction of the power each time, wherein the power reduction takes place during intervals between exposures; comparing the anode disc temperature with a second limit value which is higher than the first limit value ($T_{g1}$) and reducing the tube power to a second predetermined constant fraction, when the anode disc temperature exceeds the second limit value ($T_{g2}$) during an interval between exposures; continuously determining the temperature of the rotary anode bearings to monitor the mean value in time of the applied electric power; comparing said bearing temperature with a third limit value ($T_{1g}$), and inhibiting the start of an exposure for as long as the bearing temperature determined exceeds the third limit value.

2. A method as claimed in claim 1, wherein the first limit value corresponds to a temperature which is approximated by the anode disc temperature when the X-ray tube is loaded with an average fluoroscopic power for a prolonged period of time.

3. A method as claimed in any of the preceding claims, wherein in that the second limit value is greater than a temperature which is approximated by the anode disc when the latter is loaded for a prolonged period of time with a power at which the rotary anode bearings just reach a permissible bearing temperature.

4. A method as claimed in claim 3 wherein, when the first limit value is reached, the power which is reduced to approximately 80% of the power permissible below the first limit value.

5. A method as claimed in claim 4 wherein the power is reduced by increasing the voltage on the X-ray tube by a predetermined fraction and at the same time decreasing the tube current by between three and five times said fraction.

6. A method as claimed in claim 1 or 2 further comprising the steps of continuously determining the temperature of a housing which contains the X-ray source containing the rotary anode X-ray tubes; continuously comparing said temperature with a limit value, and inhibiting the start of the exposure when the housing temperature determined exceeds the limit value.

7. A method as claimed in claim 1 or 2 further comprising the step of simulating the temperatures in quickened mode, after at least one limit value has been exceeded, the period of time which expires until the temperature drops below the limit value again being determined and indicated by the quickened mode simulation of the temperatures.

8. Apparatus for controlling the electric load of an X-ray tube having a rotary anode disc with a bearing comprising:

generator means which supply a high voltage to the X-ray tube;

input means which supply input signals selecting a use of the X-ray tube;

control means which control the generator means in dependency of the input signals;

means which generate an anode temperature signal indicative of the temperature of the rotary anode disc of the X-ray tube;

comparator means which compare the anode temperature signal with a first limit value and which generate a reduction signal, which is applied to the control means, said reduction signal in cooperation with the input signals determining the load of the X-raty tube;

means which generate a bearing-temperature signal indicative of the temperature of the rotary anode bearing; and further comparator means which compare the anode-temperature signal with a second limit value which is larger than the first limit value, and which compare the bearing temperature signal with a third limit value, thereby generating a second and a third reduction signal respectively, said second and third reduction signal being applied to the control means for further reducing the X-ray tube load to a predetermined level or to inhibit any load respectively.

9. An apparatus as claimed in claim 8, wherein the apparatus further comprises an X-ray tube housing; means which generate a housing temperature signal indicative of the temperature of the X-ray tube housing; and further comparator means which compare the housing temperature signal with a fourth limit value and generate a fourth reduction signal for inhibiting any load to the X-ray tube.

10. An apparatus as claimed in claim 8 or 9, characterized in that said reduction signals are generated after termination of every X-ray exposure.

11. An apparatus as claimed in claim 8 or 9, characterized in that the means which generate the anode temperature signal, the bearing temperature signal and the housing temperature signal comprise electric analogic simulation circuits for real-time simulation of said temperatures.

12. An apparatus as claimed in claim 11, characterized in that, the apparatus further comprises electric analogic simulation means which simulate the anode temperature, the rotary anode bearing temperature and/or the housing temperature, using time constants which are substantially less than time constants of simulation circuits for real time simulation, wherein the comparator means compare output signals of said simulation means and corresponding limit values to determine a waiting time, and further function to prevent application of a next load to the X-ray tube during said waiting time.

13. An apparatus for controlling the electric load of an X-ray tube comprising:

generator means for supplying a high voltage to the X-ray tube, input means for supplying input signals which determine the use of the X-ray tube, control means for controlling the generator means in dependency of the input signals, processing means for generating an anode temperature signal indicative of the temperature of the rotary anode disc of the X-ray tube, for generating a bearing temperature signal indicative of the temperature of the rotary anode bearing of the X-ray tube, for comparing the anode temperature signal with a first limit value to generate a first reduction signal, for comparing the anode temperature signal with a second limit value, which is larger than the first iimit value, to generate a second reduction signal, for comparing the bearing temperature signal with a third limit value to generate a third reduction signal, for generating a power factor signal from said reduction signal, for multiplying the X-ray tube load determined by the input signals by said power factor signal to obtain a permissible load to the X-ray tube and for supplying control signals to the control means for activating the X-ray tube with said permissible load.

14. An apparatus as claimed in claim 13, wherein the power factor signal is set to unity if the anode temperature signal is less than the first limit value, is set to 0.8 if the anode temperature is between the first and second limit values and is set to zero if either the anode temperature signal or the bearing temperature signal exceeds the second or third limit value respectively.

15. An apparatus as claimed in claim 13 or 14, wherein the processor means further function to generate a housing temperature signal indicative of a temperature of an X-ray tube housing, to compare said housing temperature signal with a fourth limit value and to set the power factor signal to zero if said housing temperature signal exceeds said fourth limit value.

16. An apparatus as claimed in claim 13 or 14 wherein the processor means further function in a quick mode to simulate the anode temperature, the rotary anode bearing temperature and/or the X-ray tube housing temperature, said quick mode being substantially faster than a real time resonse of the anode, anode bearing and the X-ray tube housing to load changes, and for predetermining a waiting time, which if the second third or fourth limit value has been exceeded has to pass before a next load is applied to the X-ray tube.

* * * * *